US007377605B2

(12) United States Patent
Loyer et al.

(10) Patent No.: US 7,377,605 B2
(45) Date of Patent: May 27, 2008

(54) UNIVERSAL INKJET PRINTER DEVICE AND METHODS

(75) Inventors: Daniel W. Loyer, San Clemente, CA (US); Stephen L. Boden, San Clemente, CA (US)

(73) Assignee: MVM Technologies, Inc., San Clemente, CA (US)

( * ) Notice: Subject to any disclaimer, the term of this patent is extended or adjusted under 35 U.S.C. 154(b) by 245 days.

(21) Appl. No.: 10/525,100

(22) PCT Filed: Aug. 22, 2002

(86) PCT No.: PCT/US02/26911

§ 371 (c)(1),
(2), (4) Date: Apr. 26, 2006

(87) PCT Pub. No.: WO2004/018214

PCT Pub. Date: Mar. 4, 2004

(65) Prior Publication Data

US 2006/0250667 A1 Nov. 9, 2006

(51) Int. Cl.
*B41J 29/38* (2006.01)

(52) U.S. Cl. ..... 347/9; 347/14; 347/10

(58) Field of Classification Search ..... 347/9, 347/14, 10

See application file for complete search history.

(56) References Cited

U.S. PATENT DOCUMENTS 4,741,634 A * 5/1988 Nozaki et al. ..... 400/120.11
4,778,291 A * 10/1988 Mitsuhashi ..... 400/692
4,824,267 A * 4/1989 Nakajima ..... 400/144.2
4,872,027 A * 10/1989 Buskirk et al. ..... 347/19
4,930,915 A * 6/1990 Kikuchi et al. ..... 400/175
5,033,887 A * 7/1991 Bauerle ..... 400/175
5,049,904 A * 9/1991 Nakamura et al. ..... 347/19
5,138,344 A * 8/1992 Ujita ..... 347/86
5,668,582 A * 9/1997 Manzone et al. ..... 347/49
6,151,041 A * 11/2000 Bolash et al. ..... 347/19
6,161,920 A * 12/2000 Santhanam et al. ..... 347/50

* cited by examiner

*Primary Examiner*—Julian D Huffman
(74) *Attorney, Agent, or Firm*—Fish & Associates, PA

(57) ABSTRACT

A signal converter (180) that may perform functions to enable a thermally based technology to be used with a piezo-electric printhead (190). The signal converter and piezo-electric printhead may optionally by used in conjunction with a chassis assembly (100) having an adjustable vertical member (115) for sizing the chassis assembly to a printer. Methods of using a piezo-electric printhead in a printer having a thermal printhead configuration may include the steps of coupling the printhead to the printer and performing conversion functions.

8 Claims, 3 Drawing Sheets

FIG. 1a
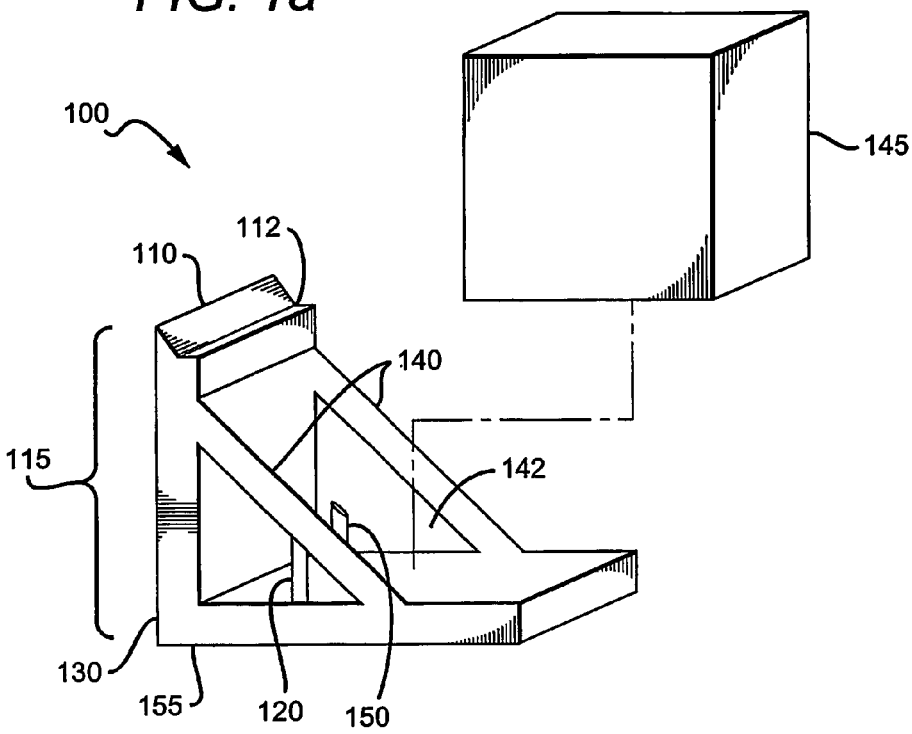
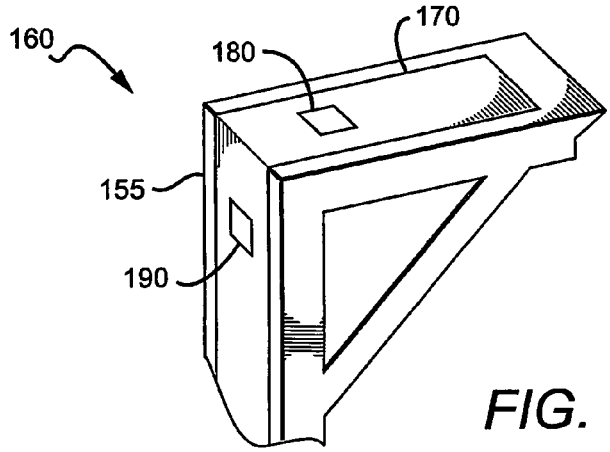
FIG. 1b

UNIVERSAL INKJET PRINTER DEVICE AND METHODS

FIELD OF THE INVENTION

The field of the invention is inkjet printing.

BACKGROUND OF THE INVENTION

In the 1970s and 1980s printer manufacturers such as Hewlett-Packard and Cannon began working on technology to replace dot matrix printers. By the 1990s inkjet printers and associated cartridges were commonly used. The term "inkjet" defines any printer that creates a printed image by firing extremely small droplets of ink onto the printer paper. Generally, the droplets of ink that produce the printed image are extremely small (between 10 and 30 droplets per millimeter), and positioned precisely. In a simple view of an inkjet printer, the ink droplets are drawn into a printhead from a printhead reservoir fluidly coupled to an ink tank. The droplets are then ejected out thru nozzles onto the paper. The printhead scans the page using a stepper motor assembly to move it back and forth along a stabilizer bar horizontally as it operates.

Inkjet technology is often classified as either continuous or drop-on-demand. A continuous technology is one in which a continuous stream of ink droplets are sprayed onto a page. Because continuous stream printers typically spray droplets at speeds exceeding one million droplets per second, these printers are extremely fast. Continuous printing, however, is expensive because there is an excessive amount of wasted ink. This is especially problematic in high resolution printers.

Drop-on-demand printers have emerged to solve at least some of the problems associated with continuous printing. Drop-on-demand printers release ink droplets only as required. Drop-on-demand technology works by forcing small droplets of ink onto print media, through nozzles. The amount of ink propelled onto the page through the ink cartridge is determined by the driver software, which dictates which nozzles shoot droplets, and when. In terms of speed, on most inkjet printers, the print head takes about half a second to print a strip across an 8.5" page.

Drop-on-demand printers generally use either a thermal bubble or piezo-electric technology to force droplets out of the nozzles of the print head. U.S. Pat. No. 5,278,584 to Hewlett-Packagrd (January 1994) teaches a thermal bubble technology in which a barrier layer containing ink channels and vaporization chambers is located between a nozzle orifice plate and a substrate layer. The substrate layer typically contains linear arrays of heater) elements, such as resistors, which are energized to heat ink within the vaporization chambers. Upon heating, a bubble is created causing an ink droplet to be ejected from a nozzle associated with the energized resistor. By selectively energizing the resistors as the print head moves across the page, the ink is expelled in a pattern on the media. A particular limitation of the thermal process is that ink should be generally heat resistant. Furthermore, the heating process creates a need for a cooling process.

Piezo-electric technology is being used by some manufacturers, such as Epson, as an alternative to thermal. A piezo-electric technology uses a crystal that reacts to an electric charge to force out droplets. In response to the charge, the crystal vibrates or expands forcing a precise amount of ink from the print head. U.S. Pat. No. 5,719,607 to Seiko Epson Corporation (February 1998) teaches a piezo system in which a piezo-electric element is used to control secretion of ink droplets. One persisting problem with print cartridges and particularly a system using a piezo element system is the high cost to make the print cartridges. This high manufacturing cost translates into a high maintenance cost for a user.

Because some printers use piezo and some use thermal there are a wide variety of print cartridges, and therefore selection of a replacement cartridge can be a tedious and time consuming activity. Additionally, there are many carriage/printhead/ink tank configurations that add to the complexity of buying replacement cartridges. Some models incorporate signal drivers in the printer electronics and some models incorporate signal drivers in the printhead on the cartridge. As a result of the need for a specialized cartridge, consumers are at the mercy of the cartridge manufacturers that charge excessively high prices for the cartridges.

Thus, there is a need for print cartridges that are more versatile and adaptable to the many different printer configurations.

SUMMARY OF THE INVENTION

Versatility and adaptability are accomplished by the present invention which includes systems and methods in which thermal printhead signals are converted into signals that can be utilized by a piezo-electric technology. The invention also includes a chassis assembly for an inkjet printer, the chassis assembly having an adjustable vertical member for sizing the assembly to be received by the inkjet printer, a signal converter, and an ink tank receiving area sized and dimensioned to house an ink tank.

Another aspect includes methods of using a piezo-electric driven printhead in a printer having a thermal printhead configuration by coupling the printhead to the printer and converting thermal printhead signals into piezo-electric printhead signals such that the piezo-electric printhead can be used. Conversion may include processes which compensate for differences in printers such as adjusting for carriage speed and calculating a drop velocity.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 1*a* is a perspective view of a chassis assembly.

FIG. 1*b* is a perspective view of a chassis assembly.

DETAILED DESCRIPTION

Figure 2:
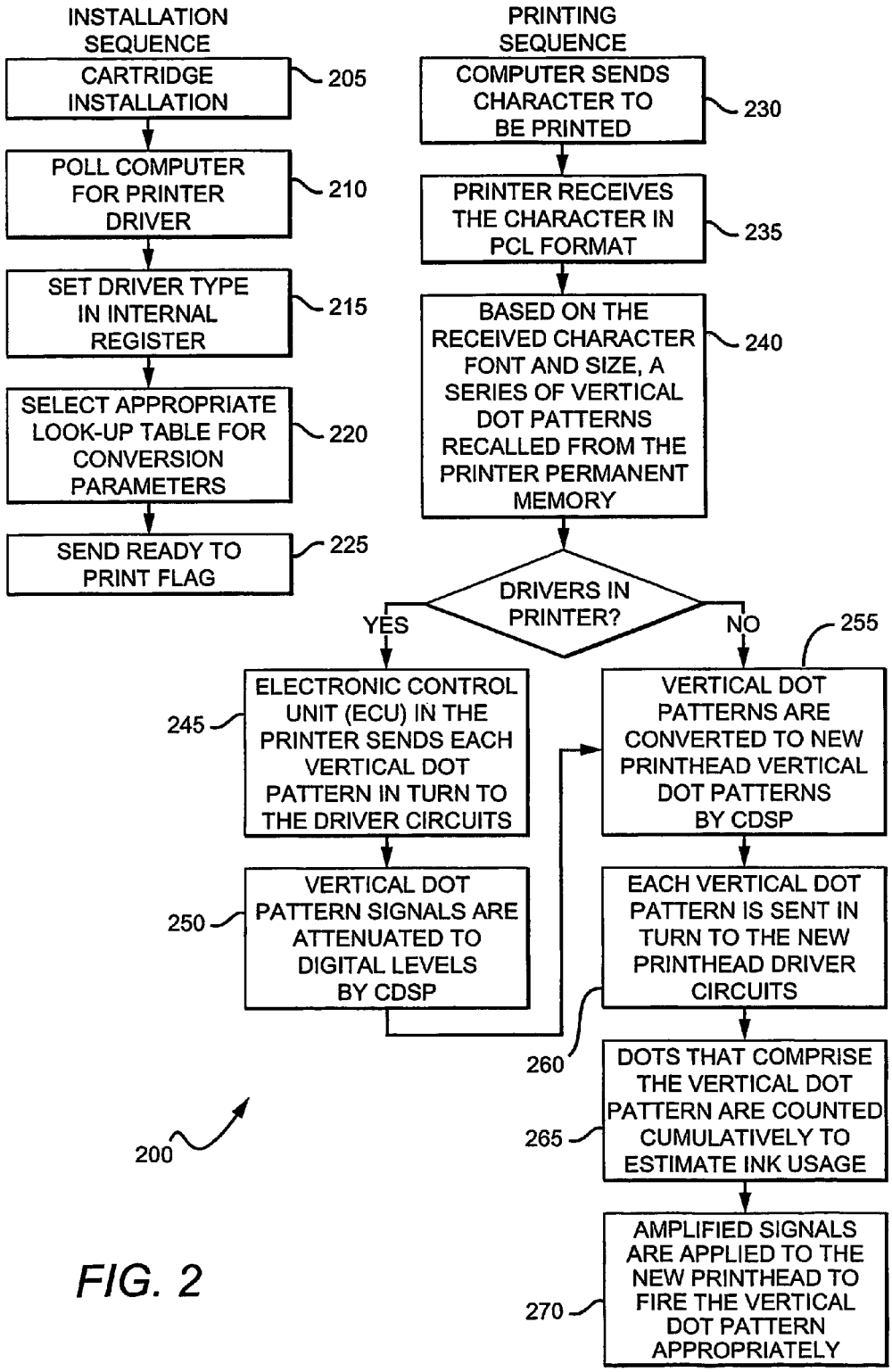
FIG. 2 is a block diagram of an operations flow.

Referring first to FIG. 1*a*, a chassis assembly 100 as depicted generally comprises a vertical member 115, two stabilizing arms 140, a base receptacle 155, a puncturing device 150, an ink feed manifold 120, and an ink tank 145.

A preferred chassis assembly has an adjustable vertical member 115 allowing it to be accepted by various sized chassis receiving areas and therefore used in a variety of different printers. The adjustability of a vertical member 115 may be accomplished by providing a contact ridge 110 that can be optionally removed. In certain printer carriage configurations, the size of the chassis receiving area may be too small to accept the chassis assembly, and in such instances, the contact ridge 110 may be readily removed or otherwise shortened or trimmed to reduce the overall size of the vertical member 115. Reduction of the size of the vertical member 115 may be accomplished by providing a perforated edge 112 that can be manipulated to enable removal of the contact ridge 110. It should be appreciated that an adjustment to the vertical member may enlarge or alter the size of the vertical member rather than reduce it, and the method of reduction, enlargement or alteration may also vary.

A vertical member 115 is preferably susceptible to acceptance by a chassis receiving area (not shown). The chassis receiving area of a printer generally has means of securing a chassis assembly in place as for example by clamps that grip the chassis assembly at certain points. In preferred embodiments, a chassis may be clamped at a lower clamping point 130 as well as at the contact ridge 110. Optional stabilizing arms 140 provide rigidity aiding the secure connection of the carriage during clamping. The stabilizing arms may also provide a housing for an ink tank 145 which is preferably located in the area between the two stabilizing arms—the ink tank receiving area 142. An incidental function of the stabilizing arms is to reduce vibration by the chassis assembly 100 during printing.

A preferred chassis assembly has a puncturing device 150 that is used to penetrate an ink tank 145 so that ink may flow from the tank 145, and a preferred ink will have properties that allow it to flow freely without need of induced pressure from either an engineered sponge or other pressurizing system. It is contemplated that puncturing of an ink tank 145 may occur while a new ink tank is being placed in a carriage assembly and the puncturing device 150 may also be coupled to an ink feed manifold 120. An ink feed manifold 120 generally defines a path for the ink between the ink tank 145 and a printhead ink reservoir (not shown), although in some aspects an ink tank 145 will connect directly to a printhead. Ink tanks may be removable and easily replaceable without replacing an entire chassis assembly. Although one ink tank is depicted in FIG. 1*a*, in other embodiments there may be multiple ink tanks each housing a separate color. In other embodiments, additional ink tanks may contain the same color as one may act as a backup for the other should the operable ink tank run out of ink or become clogged or otherwise inoperable. A particularly noteworthy aspect of an ink tank is that the outer housing may be comprised of a recyclable material including a recycled waste. A related concept includes ink that is made from recyclable materials.

With regard to the base receptacle 155, a preferred configuration includes a foil (i.e. flexible) printed circuit board (pcb) 170 as depicted in FIG. 1*b*. The pcb is generally mounted on the base receptacle 155 and provides contact points for printer electronics. The foil pcb also houses a signal converter 180 and a piezo-electric printhead 190.

A signal converter 180 of a preferred embodiment is a semi-conductor on which an integrated circuit is embedded. As its name indicates, a signal converter 180 is preferably programmed (burned) to handle conversion functions. It is contemplated that a conversion chip 180 may be a type of flash memory chip or other EEPROM, but any type of chip that can perform the chip's functions will be suitable. Conversion functions are those tasks/calculations, etc. necessary to enable the chassis assembly to cooperate with most any printer. Some of the functions of a conversion chip 180 are: polling a computer to determine what type of printer is being used, synchronizing carriage speed, drop velocity, drops per inch, and firing rates. Additional functions and function descriptions are expanded upon infra under FIG. 2.

With respect to a piezo-electric printhead 190, it is generally contemplated that the printhead will reside on the pcb 170. It is contemplated that a piezo-electric printhead 190 will communicate electrically with a signal converter 180 and will also communicate fluidly with an ink feed manifold 120. In a preferred class of embodiments, a piezo-electric printhead is comprised of up to 400 nozzles, each being controlled by an associated piezo-electric crystal. Additionally contemplated nozzles may vary in size to compensate for carriage speed and drop velocity differences. The process of printing a single dot may include a determination of which nozzles to fire. Such a determination will typically be made by the signal conversion chip 180 and then communicated to the printhead 190. In another less preferred embodiment, a signal converter may be housed in the printhead itself.

FIG. 2 depicts operations flows associated with a chassis assembly including steps that are performed upon installation and steps that are performed subsequent to installation. These and other steps may be performed in order to use a piezo-electric printhead in a printer having a thermal printhead configuration.

Beginning with the installation sequence, a cartridge (carriage assembly) is installed 205 and once power is applied the cartridge, a signal converter automatically (i.e. without user interaction) polls the appropriate computer for a printer driver 210. Polling of the computer is generally performed by the converter chip and includes sensing of the computer and its device drivers. Upon determination of an applicable device driver, the driver type will be set in an internal register 215. Such internal registers may be areas of storage residing in the printer electronics or on the cartridge. The printer driver may be used to lookup appropriate conversion tables and set parameters that will be used during the printing sequence to automatically synchronize and automatically adjust the operation of the piezo-electric printhead. The parameters that are set generally relate to printer performance and include carriage speed, drop velocity, drops per inch horizontally and vertically, single or bi-directional printing, and drop firing pulse repetition rate. These parameters advantageously result in a single transform that is used to convert a vertical dot pattern issued by the printer to a vertical dot pattern required by a piezo-electric printhead.

A printing sequence generally begins when a computer communicates a character or series of characters to a printer for printing. 230. The character is preferably in a PGL (Hewlett-Packard graphics language) format when it is received by the printer electronics 240. Based on the character(s) and their attributes, a series of vertical dot patterns are recalled from the printer's permanent memory 240. At this point, it is important to recognize that printhead drivers may be located either on the printhead or within printer electronics (i.e. not on the printhead). If the printhead drivers are not located within the printer electronics, a typical operation may include the step of sending each vertical dot pattern to the driver circuits 245. Continuing with an embodiment in which the printhead drivers are located within the printer electronics, the vertical dot pattern signals, which are generally amplified analog signals at this point, may be too strong and therefore require attenuation to a digital level by the converter chip 250.

Regardless of whether the printhead drivers are located within the printer electronics, the next step in the exemplified printing sequence involves the converter chip converting vertical dot patterns 255. Conversion is contemplated to include a step of determining which of the nozzles will be fired to produce the vertical dot pattern corresponding to the character to be printed. Following the aforementioned step, each vertical dot pattern is sent in turn to the new printhead driver circuits typically located on the piezo-electric printhead 260. It may be advantageous to amplify the signals and apply them to the new printhead to fire the vertical dot pattern that is appropriate for the new carriage assembly 270.

Ink usage and ink availability may be computed by various means. It is contemplated that by counting the number of dots that comprise a vertical dot pattern, ink usage may be estimated 265. Other known means of detecting and/or estimating the ink usage may be incorporated including means in which the ink level in the ink tank is measured and means in which the flow of ink from the ink tank is measured. Such measurements may encompass use of level and/or flow type sensors. It is contemplated that ink usage and ink availability may be communicated back to the computer user and displayed graphically.

Conversion of a first type of signal to a second type of signal may optionally include the functions of: sensing and adjusting to a carriage speed; adjusting a drop velocity, and adjusting a drop firing pulse repetition rate. Such adjustments are typically based on the type of printer being used in conjunction with the chassis assembly. The adjustments are preferably performed by the signal converter 180.

Carriage speed is generally considered to be directly proportional to resolution and drop velocity of a given printhead. Since carriage speed differs among printers, the carriage speed may need to be sensed and compensated for to allow the chassis assembly to match the carriage speed to drop output. In some cases, drop frequency may need to be adjusted to match carriage velocity. Another consideration is the vertical speed of the paper feed and as a converter chip matches drop frequency to carriage speed, it also matches the vertical paper feed speed.

Another factor may be whether the printer allows for application of ink in more than one direction. If so, a converter may sense the bi-directional status and compensate for it.

Signal cycle is yet another factor that may be important to the operation of a piezo-electric printhead interfacing with a traditionally thermal printer. The signals referred to here are those that are associated with the various stages in the operation of a piezo-electric printhead—a fill stage, a pressurize stage, a relax stage, and an eject stage.

Figure 3:
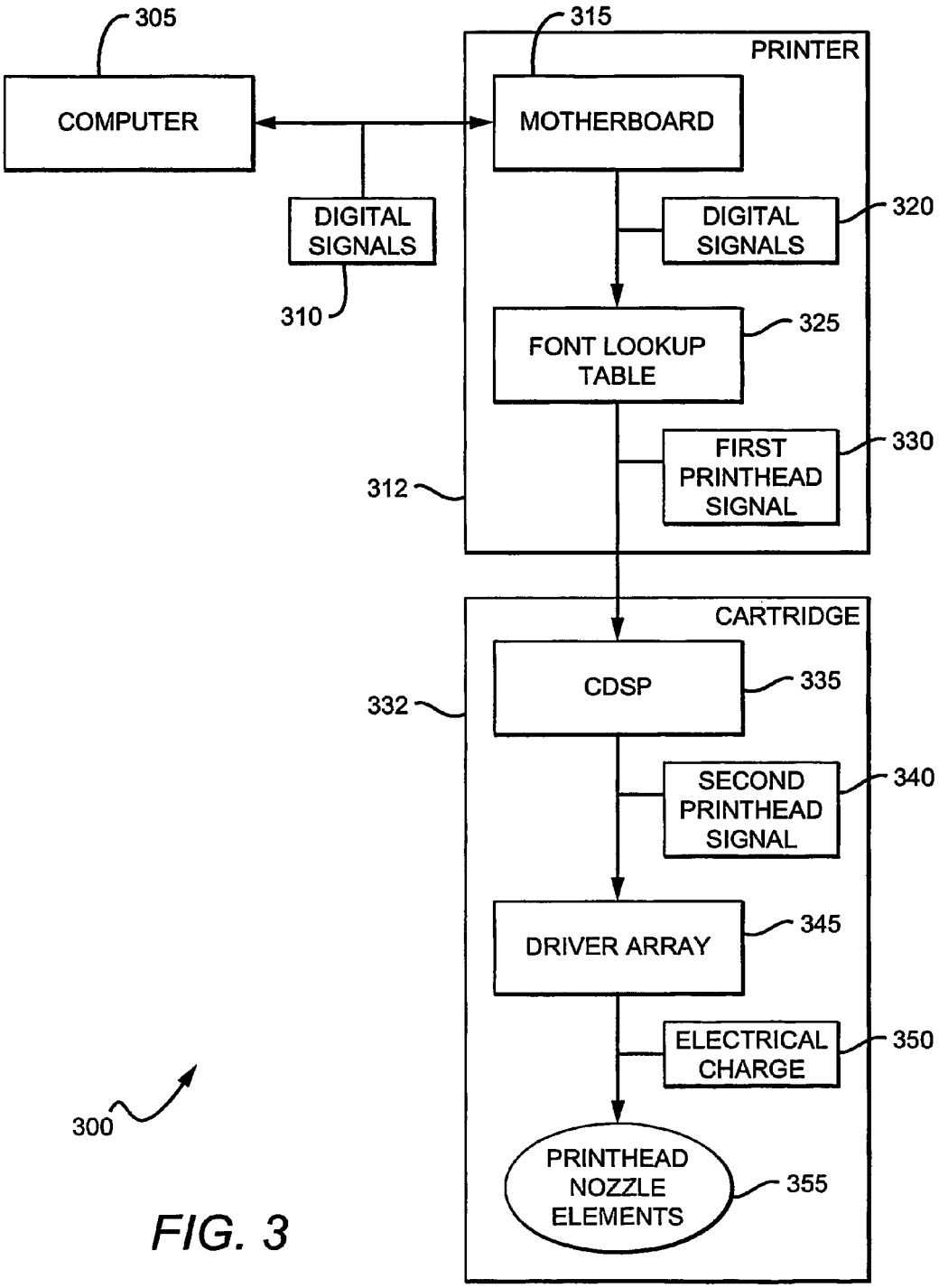
FIG. 3 is a block diagram of signal flow from the computer to the printhead.

Focusing on FIG. 3, a signal flow schematic 300 generally shows the signal flow between a computer 305, a printer 312, and a cartridge (chassis assembly) 332.

A computer 305 is any device that interfaces with a printer for the purpose of printing including a desktop device, a notebook, a PDA, and a telematics device. Transmission of data from a computer 305 to a printer's motherboard 315 preferably traverses a wired path from a parallel port on the computer, however other methods of transmission should not be excluded. In some embodiments, a computer and a printer will communicate wirelessly as for example by using a Blue Tooth technology. In any case, digital signals 320 are applied to the font lookup table 325.

The signal that enters the CDSP (custom digital signal processor) is a first printhead signal 330. A first printhead signal is defined herein as a signal that is configured for use with a thermal printhead technology. The signal output by the CDSP 335 is a second printhead signal 340 which is a signal configured for use with a piezo-electric printhead technology. That second signal 340 is applied to the driver array 345 (printhead drivers), and following that application electrical charges are sent to the appropriate piezo-electric crystals thereby firing the corresponding nozzels and ejecting ink on the print media.

Thus, specific embodiments and applications of a universal inkjet printer device and methods have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A cartridge chassis assembly for an inkjet printer, comprising:

an adjustable vertical member for sizing the chassis assembly to the inkjet printer;

a signal converter that senses a first printhead signal and converts the first printhead signal into a second printhead signal; and a piezo-electric printhead that ejects ink at least partly as a function of the second printhead signal.

2. The cartridge chassis assembly of claim 1, further comprising an ink tank receiving area sized and dimensioned to house an ink tank that cooperates with the piezo-electric printhead.

3. The cartridge chassis assembly of claim 1, wherein the adjustable vertical member has a contact ridge that is readily removable such that the chassis assembly adjusts to fit a chassis receiving area.

4. The cartridge chassis assembly of claim 1, wherein the piezo-electric printhead houses the signal converter.

5. The cartridge chassis assembly of claim 1, wherein signal drivers are resident in the printer's electronics.

6. The cartridge chassis assembly of claim 5, wherein the first printhead signal is an analog signal.

7. The cartridge chassis assembly of claim 1, wherein the signal converter is configured to sense a printer model and driver type.

8. A printer comprising the cartridge chassis assembly of claim 1.

* * * * *